US005216839A

United States Patent [19]

Woodruff

[11] Patent Number: 5,216,839

[45] Date of Patent: Jun. 8, 1993

[54] REVERSIBLE HINGE DOOR ASSEMBLY

[75] Inventor: Alan H. Woodruff, Altoona, Iowa

[73] Assignee: Emco Specialties, Inc., Des Moines, Iowa

[21] Appl. No.: 734,338

[22] Filed: Jul. 19, 1991

[51] Int. Cl.[5] ..... E05D 7/02

[52] U.S. Cl. ..... 49/382; 49/484.1; 49/490.1; 49/495.1; 49/475.1; 49/504

[58] Field of Search ..... 49/382, 381, 504, 484, 49/486, 488, 490, 495

[56] References Cited

U.S. PATENT DOCUMENTS

| | | | |
|---|---|---|---|
| 3,296,743 | 1/1967 | Curl | 49/382 |
| 3,298,135 | 1/1967 | Kinser | 49/382 X |
| 3,774,345 | 11/1973 | Cole et al. | 49/504 |
| 4,015,368 | 4/1977 | Court et al. | 49/488 |
| 4,031,665 | 6/1977 | Abramson | 49/488 X |
| 4,106,238 | 8/1978 | Bonello | 49/382 |
| 4,281,480 | 8/1981 | Wendt | 49/504 |
| 4,343,110 | 8/1982 | Thompson | 49/488 X |
| 4,403,452 | 9/1983 | Urbanick | 49/488 X |

*Primary Examiner*—Peter M. Cuomo
*Assistant Examiner*—Jerry Redman
*Attorney, Agent, or Firm*—Zarley, McKee, Thomte, Voorhees, & Sease

[57] ABSTRACT

A reversible hinge door assembly includes a pair of door brackets fitted on the opposite edges of the door to be mounted. The door brackets each include longitudinal channels for receiving a hinge bracket. The hinge bracket may be mounted in either of the hollow channels of the door brackets at the opposite edges of the door. The hinge is mounted to the door bracket. The hinge may be reversed from one side of the door to the other by sliding the hinge bracket out of the channel in the door bracket on one side of the door and by reinserting it into the hollow channel of the door bracket on the other side of the door.

13 Claims, 2 Drawing Sheets

REVERSIBLE HINGE DOOR ASSEMBLY

BACKGROUND OF THE INVENTION

This invention relates to a reversible hinge door assembly and method for using same. Specifically, the present invention has particular applicability with respect to storm doors which are often sold for installation by do-it-yourself home improvers.

One problem encountered with such storm doors is that they must be manufactured and sold with the hinged side of the door being irreversible. Thus, it is necessary to manufacture right-hand hinged doors and left-hand hinged doors.

Some attempts have been made in the prior art to develop a reversible hinge door which permits the mounting of the hinge on either side of the door. However, suitable means have not been provided for mounting the hinge on either side of the door.

Therefore, a primary object of the present invention is the provision of an improved reversible hinge door assembly and a method for using the same.

A further object of the present invention is the provision of a reversible hinge door assembly which permits simple and easy vertical adjustment of the hinge with respect to the edge of the door so that proper orientation can be achieved between the hinge and the edge of the door.

A further object of the present invention is the provision of a reversible hinge door assembly which permits the hinge to be mounted easily and quickly on either side of the door at the time of installation.

A further object of the present invention is the provision of a reversible hinge door assembly which includes novel, reversible weather-stripping means for the hinge side of the door and for the latch side of the door.

A further object of the present invention is the provision of an improved reversible hinge door assembly and method for using same which utilizes aluminum extrusions for mounting brackets for the door and for the hinge.

A further object of the present invention is the provision of an improved hinge door assembly and method for using same which are economical to manufacture, durable in use, and efficient in operation.

SUMMARY OF THE INVENTION

The reversible hinge door assembly of the present invention utilizes a pair of identical door brackets which are mounted on the opposite edges of the door to be mounted. The door brackets each include an elongated channel which extends along the edge of the door to which the door bracket is mounted.

A hinge bracket having a top hat shaped cross sectional configuration is slidably mounted within the channel formed by the door bracket. The hinge bracket can slide vertically within either of the hollow channels of either of the two door brackets. The central web portion of the top hat shaped door bracket provides a flat surface to which one flap of the hinge can be connected. The other flap of the hinge is adapted to be mounted to a Z-shaped jamb bracket or Z-bar which is mounted on the door jamb of the opening for the door.

When the door assembly is sold for use by a contractor or a do-it-yourself home improvement person, one flap of the hinge is riveted or otherwise secured to the flat central web of the hinge bracket. The other flap of the hinge is attached by screws to a Z-bar. The person installing the door determines at the construction site whether the door will be hinged at the left or right-hand side of the door. If the door is to be hinged at the right-hand side of the door, the hinge bracket is slidably inserted into the channel of the door bracket at the right-hand side of the door. Conversely, if the door is to be hinged on the left, the hinge bracket is slidably inserted into the channel on the door bracket into the channel of the door bracket on the left-hand edge of the door.

Pre-drilled holes are provided in the flap of the hinge, in the central web of the hinge bracket, and in the door brackets. These holes may be aligned by sliding the hinge bracket upwardly and downwardly until all the holes are properly aligned. Then screws may be inserted through the holes and into the door to securely fasten the hinge to the edge of the door. The Z-bars are then screw-mounted to the side jambs of the door opening. The hole for the handle to the door is cut in the door at the site after a determination has been made as to whether or not the door will be a right-hand hinged door or a left-hand hinged door.

A plastic C-shaped channel is adapted to be fitted over the door bracket on the latch side of the door, and includes a pair of plastic sealing flaps adapted to seal against a portion of the Z-bar mounted on the door jamb. These sealing flaps are of a different durometer reading than the plastic of the remaining portion of the plastic channel. This construction is referred to as a dual-durometer construction, wherein the sealing flaps are made of a more flexible plastic than the remainder of the device.

A novel weather-strip means is provided for the hinge side of the door and includes an L-shaped channel which is adapted to fit around a portion of the Z-bar mounted on the door jamb. The L-shape plastic channel also includes sealing flaps of a dual-durometer construction which are adapted to sealably engage the hinge side of the door when it is closed.

When the hinge is reversed, the two plastic sealing channels can also be reversed to opposite sides of the door to accommodate the reversal of the hinge.

BRIEF DESCRIPTION OF THE DRAWINGS

FIG. 3 is a sectional view showing the screw attachment for the various parts of the door assembly.

DESCRIPTION OF THE PREFERRED EMBODIMENT

Figure 2:
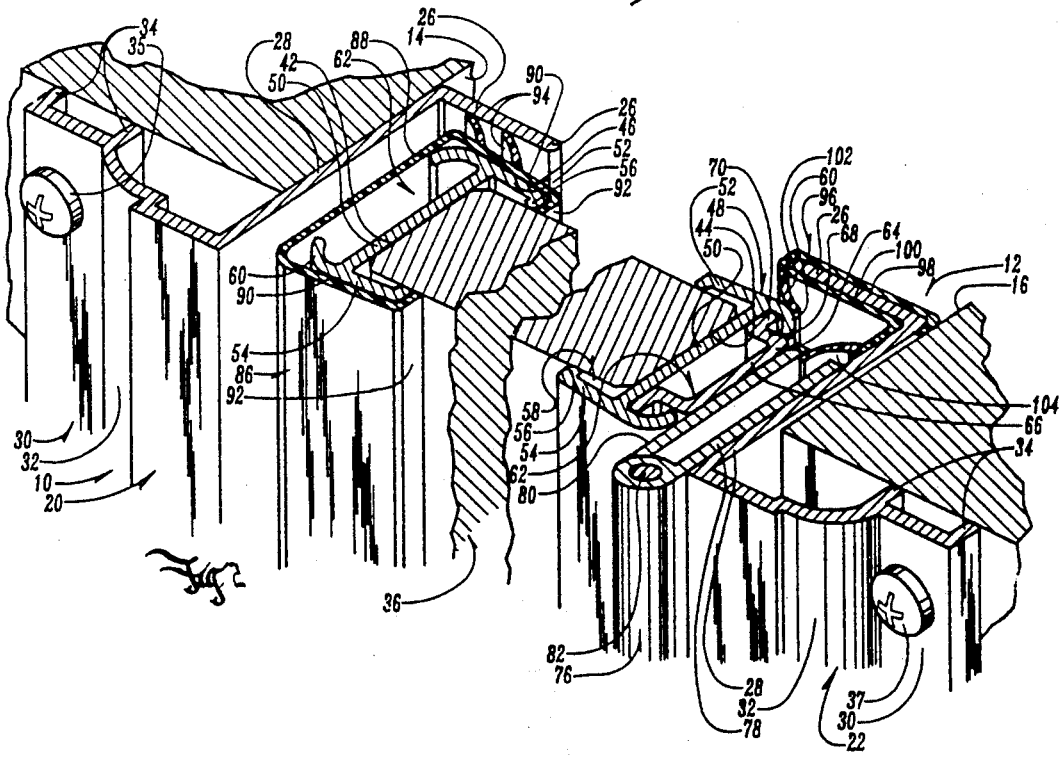
FIG. 2 is a sectional pictorial view taken along line 2—2 of FIG. 1.

Referring to the drawings, the numeral 10 generally designates the door assembly of the present invention. Door assembly 10 is adapted to be mounted in a door opening 12 (FIGS. 2 and 3) defined by opposite door jambs 14, 16, a threshold 18, and a door header (not shown).

Figure 4:
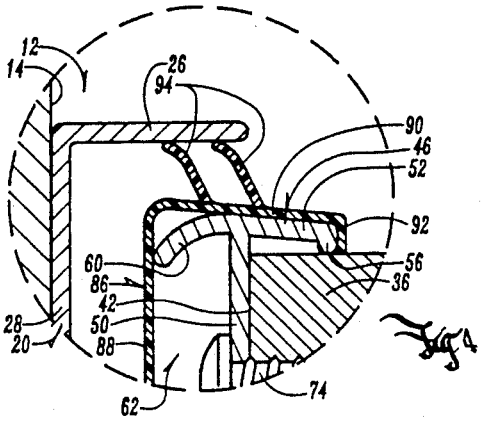
FIG. 4 is an enlarged detailed sectional view taken along line 4—4 of FIG. 3.
Figure 1:
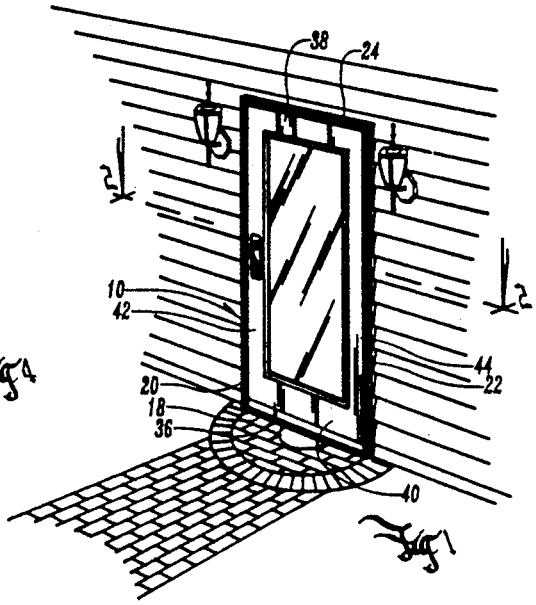
FIG. 1 is a perspective view of a conventional storm door mounted on the exterior wall of a building.

Rigidly mounted to door jambs 14, 16 are a pair of jamb brackets or Z-bars 20, 22 which are of identical construction. A similar rain cap or Z-bar 24 (FIG. 1) is provided across the top of the door and is mounted to the header of the door 10. Each Z-bar 20, 22, 24 includes a sealing flange 26 which provides a sealing surface for the interior surface of the door. Sealing flange 26 is connected to a central flange 28 which fits in abutting, facing engagement with the door jambs 14, 16. A face flange 30 includes an arch portion 32 and a pair of landing ribs 34 which engage the exterior surface surrounding the door opening 20. Screws 35, 37 extend through the face flange 30 between the two landing ribs 34 and secure the Z-bars 20, 22, 24 to the perimeter of the door opening.

A door 36 includes an upper edge 38, a lower edge 40, and two opposite side edges 42, 44. Mounted over the side edges 42, 44 of door 36 are a first door bracket 46 and a second door bracket 48 respectively. Door brackets 46, 48 are of identical construction and are H-shaped in cross section. They include a central web 50 having a pair of spaced-apart side flanges 52, 54 which form the legs of the H-shaped configuration. The two side flanges 52, 54 each terminate at one edge in a lip 56 and at the other edge in a curved end 60. Lips 56 together with web 50 form an elongated door receiving channel in which is inserted one of the side edges 42, 44 of door 36. The lips 56 are biased inwardly toward the door and retentively engage the front and rear surfaces of the door.

On the opposite side of web 50 is a hinge bracket channel 62. Slidably mounted within hinge bracket channel 62 is a hinge bracket 64. Bracket 64 in cross section is in the form of a top hat, having a central web 66, two opposite perpendicular leg portions 68, and two outwardly extending lip or rim portions 70.

A hinge 76 includes a first flap 78 and a second flap 80 pivotally connected by a hinge pin 82. A screw 72 extends through a hole 73 in hinge flap 80, then through a hole (not shown (in hinge bracket 64, and then through another hole 75 (FIG. 5) in the central web 50 of door bracket 48. During manufacture of the device, and before it is sold to the contractor, the hinge flap 80 is secured to the central web 66 of hinge bracket 64 by means of one or two rivets 77. Also, at the time of manufacture, the other hinge flap 78 is secured to the Z-bar 22 by means of screws 84.

Figure 5:
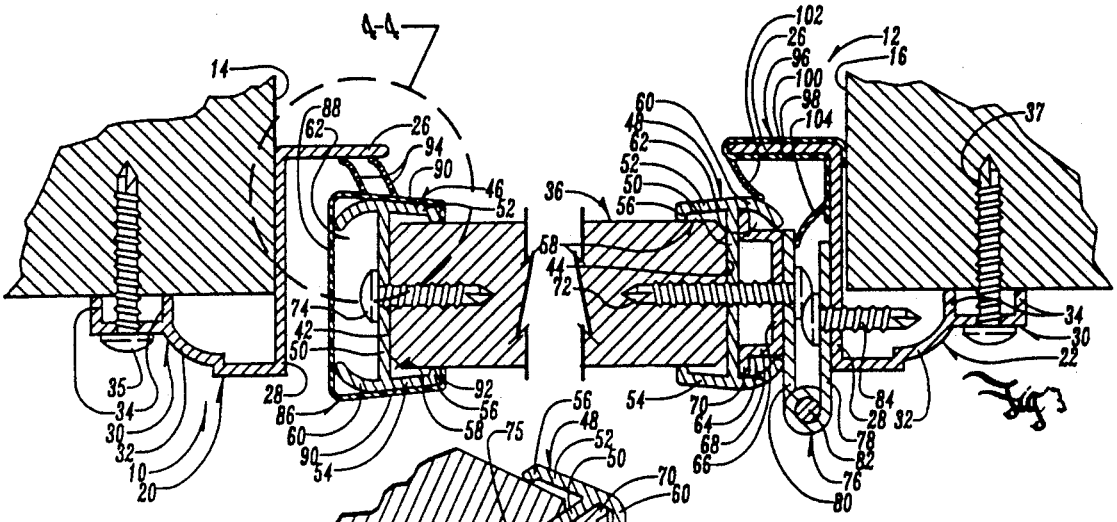
FIG. 5 is a detailed perspective view showing the method of insertion of the hinge bracket into the door bracket.

As can be seen in FIG. 5, the hinge 76 is mounted at the construction site to the edge of the door by sliding hinge bracket 64 within the channel 62 until the holes 73, 75 are in registered alignment. Then screws 72 are inserted through the holes and are threaded into the edge of the door as shown in FIG. 3.

The other door bracket 46 is secured to edge of the door by means of a screw 74. As can be seen in FIG. 5, it is very easy for the person installing the door to slide the hinge bracket 64 vertically until there is proper registered alignment between the holes 73, 75. Preferably the hinge 76 extends the entire length of the door; although, it is possible to have separate hinges mounted to the hinge bracket 64 at various points along its length. After the hinge 76 is mounted to the door 36 in the manner described above, the Z-bar 22 is attached to the door jamb by a series of screws 37 (FIG. 3).

A first weather seal member 86 is mounted over the handle or latch side of the door and in cross section includes a central web 88 and opposite spaced apart legs 90. At the ends of legs 90 are a pair of inwardly extending lips 92 which engage the front and rear surfaces of the door for gripping the door, and for engaging the lips 56 of the door bracket 46 to hold the first weather seal member 86 thereto. The weather seal member 86 also includes a pair of sealing flaps 94 which are adapted to engage the sealing flange 26 when the door is closed so as to provide an airtight seal. Seal member 86 is formed of a dual-durometer plastic material, with the plastic of the C-shaped portion being of a more rigid material and with the flaps 94 being comprised of a more flexible material so that they will flex when they engage flange 26 and provide a good airtight seal.

A second dual-durometer plastic seal member 96 is adapted to be mounted adjacent the hinge side of the door. Seal member 96 includes two oppositely positioned, L-shaped legs which form an L-shaped groove therebetween for receiving the sealing flange 26 and part of the central flange 28 of Z-bar 22 as shown in FIG. 3. Seal member 96 includes a pair of sealing flaps 102, 104 constructed of a material more flexible than the material of the L-shaped legs thereof. Flaps 102, 104 engage the door bracket member 48 and the hinge flap 80 of hinge 76. This provides an airtight seal adjacent the hinge edge of the door.

First seal member 86 and second seal member 96 can be reversed from the positions shown in the drawings. That is, first seal member 86 may be mounted over the second door bracket 48, and the second seal member 96 can be mounted over the sealing flange 26 of the first Z-bar 20. This reversal would take place if the hinge 76 and the hinge bracket 64 were attached to the first door bracket 46 rather than the second door bracket 48 as shown in the drawings. The door handle 106 is mounted to the door after it has been determined which side the hinge will be mounted upon. The appropriate holes are cut for the latch mechanism for the door handle, and the door handle is mounted on the appropriate side.

Thus, it can been seen that the device accomplishes all of its stated objectives. The hinge bracket 64 can be mounted to either side of the door merely by sliding it within the hollow channels in the respective door brackets. This permits the hinge to be mounted to either side of the door depending upon the particular needs at the construction site. As the hinge bracket is slidably inserted into the hinge bracket 62 of the door bracket, the holes 73, 75 (FIG. 5) can be properly aligned for receiving the screws 72. This is a distinct advantage over prior devices for mounting the hinges to the doors. Aligning the predrilled holes in prior devices is a very difficult task.

The reversibility of the sealing members 86, 96 also facilitates the reversal of the hinge. The mechanism is simple to understand and operate, and therefore is readily usable by do-it-yourself home improvers.

I claim:

1. A reversible hinge door assembly for use in a door opening formed by a door frame having a header, a threshold, a first and second opposite door jambs, said door assembly comprising:

first and second jamb brackets, each operatively attached to said first and second door jambs respectively, each of said first and second jamb brackets including a vertical flat sealing flange extending inwardly into said door opening;

a door within said door frame and having a first side edge adjacent said first jamb bracket and a second side edge adjacent said second jamb bracket;

first and second elongated door bracket means attached to said first and second side edges of said door respectively, each of said first and second door bracket means having an elongated vertical hinge bracket channel therein;

an elongated hinge bracket means slidably fitted within said hinge bracket channel of said first door bracket means for vertical sliding movement therein, said hinge bracket means having a vertical hinge receiving surface;

an elongated hinge means separate from said hinge bracket means and having first and second hinge flaps pivotally connected to one another for hinged movement about a vertical axis said first hinge flap being in facing engagement with said hinge receiving surface of said hinge bracket means;

first securing means detachably securing said first hinge flap to said hinge bracket means, said first door bracket means, and said first side edge of said door;

second securing means detachably securing said second hinge flap to said first jamb bracket whereby said door will swing about said vertical hinge axis adjacent said first side of said door from a closed position to an open position;

said hinge means and said hinge bracket means being removable from said hinge bracket channel of said first door bracket means and said first jamb bracket by detachment of said first and second securing means respectively;

said hinge bracket means being capable of slidably fitting within said hinge bracket channel of said second door bracket means for vertical sliding movement therein;

said first securing means being capable of re-attaching said first hinge flap of said hinge means to said hinge bracket means, said second door bracket means and said second side edge of said door while said hinge bracket means is fitted within said hinge bracket channel of said second door bracket means;

said second securing means being capable of attaching said second hinge flap to said second jamb bracket when said first hinge flap is connected to said hinge bracket means, said door bracket means, and said second side edge of said door, whereby said door will swing about said vertical hinge axis adjacent said second side edge of said door from a closed to an open position;

a first sealing member having in cross section two oppositely positioned legs forming a groove therebetween, said sealing flange of said first jamb bracket means being fitted between said two oppositely positioned legs and within said groove, said first sealing member including at least one sealing flap engaging said first door bracket means for providing a seal between said door frame and said first side edge of said door;

a second sealing member having in cross section a C-shaped portion and at least one sealing flap, said C-shaped portion being detachably secured to said second door bracket means in covering relation over said hinge bracket channel thereof, said sealing flap of said second sealing member engaging said sealing flange of said second jamb bracket means for providing a seal between said door frame and said second side of said door.

2. A door assembly according to claim 1 wherein said first weather-strip means is removable from said sealing flange of said first jamb bracket and is detachably attachable to said sealing flange of said second jamb bracket, said second weather-strip means being removable from said second door bracket and being detachably attachable to said first door bracket.

3. A door assembly according to claim 1 wherein each of said door bracket means have an approximate H-shaped cross section, comprising a web portion and opposite spaced apart side flanges extending perpendicular to said web portion so as to form a hollow channel on one side of said web portion and so as to form a door receiving channel on the opposite side of said web portion, said opposite side edges of said door being fitted within said door receiving channels of said first door bracket means and said second door bracket means respectively.

4. A door assembly according to claim 3 wherein said side flanges of said first and second door bracket means converge toward one another to form sidewalls of said hollow channels and so as to limit movement of said hinge bracket out of said hollow channels in a direction laterally away from said side edges of said door.

5. A door assembly according to claim 4 wherein said hinge bracket in cross section includes a central web portion, a pair of spaced apart hat legs extending perpendicularly from the opposite edges of said central web portion, and a pair of hat brim flanges extending perpendicularly from said hat legs.

6. A reversible hinge door assembly according to claim 1 wherein said C-shaped portion of said second sealing member comprises a C-web and two opposite spaced apart C-legs, said two opposite C-legs retentively and detachably embracing said second door bracket means therebetween with said C-web being in covering relation over said hinge bracket channel of said second door bracket means, said second sealing member being removable from said second door bracket means and being capable of detachable securement to said first door bracket means with said C-legs detachably and retentively embracing said first door bracket means therebetween and with said C-web in covering relation over said hinge bracket channel of said first door bracket means.

7. A reversible hinge door assembly according to claim 6 wherein said sealing flap of said second sealing member engages said first jamb bracket when said second sealing member is detachably secured to said first door bracket means.

8. A reversible hinge door assembly according to claim 7 wherein said second sealing member is of dual durometer construction with said C-legs and said C-web being formed of a first plastic material having a first durometer value and with said sealing flap being formed of a second plastic material having a second durometer value and being more flexible than said first plastic material.

9. A reversible hinge door assembly comprising:

a door having a front face, a rear face, first and second opposite vertical edges, an upper edge, and a lower edge;

first and second elongated door bracket means retentively engaging and extending along the lengths of said first and second side edges respectively of said door, each of said first and second door bracket means having an elongated channel extending along the length thereof, said channel having in cross section a bottom wall, a pair of spaced apart sidewalls spaced apart from one another a first distance, and a pair of lips extending inwardly toward one another from said sidewalls and being spaced apart from one another a second distance less than said first distance;

an elongated hinge bracket means comprising in cross section a pair of side flanges spaced apart from one another a third distance less than said first distance and greater than said second distance, said side flanges being positioned between said sidewalls of said channel of said first door bracket means with one of said side flanges being between said bottom wall and one of said lips of said channel and with the other of said side flanges being between said bottom wall and the other of said lips of said channel whereby said hinge bracket means is free to slide longitudinally in said channel and both of said lips of said channel retain said hinge bracket means within said channel of said first door bracket means;

said hinge bracket means having a central web portion between said opposite hinge bracket side flanges, said central web portion having an elongated flat surface extending outwardly from said channel of said first door bracket means beyond said lips of said channel;

elongated hinge means extending approximately along the entire length of said door, said hinge means being separate from said hinge bracket means and having a pair of vertical flat hinge flaps and an elongated hinge joint therebetween, one of said hinge flaps being in facing engagement with said elongated flat surface of said hinge bracket means;

said hinge bracket means being longitudinally slidable within said channel of said first door bracket means for removal therefrom and being longitudinally slidable in the same fashion within said channel of said second door bracket means for permitting reversal of the mounting of said hinge bracket means from said first edge of said door to said second edge of said door;

securing means for detachably securing said one hinge flap and said channel of said first door bracket means or within said channel of said second door bracket means.

10. A reversible hinge door assembly comprising:

a door having a front face, a rear face, first and second opposite vertical edges, an upper edge, and a lower edge;

first and second elongated door bracket means retentively engaging and extending along the length of said first and second side edges respectively of said door, each of said first and second door bracket means having an elongated channel extending along the length thereof, said channel having in cross section a bottom wall, a pair of spaced apart sidewalls spaced apart from one another a first distance, and a pair of lips extending inwardly toward one another from said sidewalls and being spaced apart from one another a second distance less than said first distance;

said first and second door bracket means each including a vertical flat sealing flange extending vertically along the length thereof, a first sealing member having a pair of parallel legs embracing said sealing flange of said first door bracket therebetween and having at least one sealing flap engaging said first door bracket means, a second sealing member detachably secured to said second door bracket means and having at least one sealing flap engaging said sealing flange of said elongated second door bracket means, said first sealing member being removable from said sealing flange of said first door bracket means and re-attachable to said sealing flange of said second door bracket means, said second sealing member being removable from said second door bracket means and re-attachable to said first door bracket means;

an elongated hinge bracket means comprising in cross section a pair of side flanges spaced apart from one another a third distance less than said first distance and greater than said second distance, said side flanges being positioned between said sidewalls of said channel of said first door bracket means with one of said side flanges being between said bottom wall and one of said lips of said channel and with the other of said side flanges being between said bottom wall and the other of said lips of said channel whereby said hinge bracket means is free to slide longitudinally in said channel and both of said lips of said channel retain said hinge bracket means within said channel of said first door bracket means;

said hinge bracket means having a central web portion between said opposite hinge bracket side flanges, said central web portion having an elongated flat surface extending outwardly from said channel of said first door bracket means beyond said lips of said channel;

elongated hinge means extending approximately along the entire length of said door, said hinge means being separate from said hinge bracket means and having a pair of vertical flat hinge flaps and an elongated hinge joint therebetween, one of said hinge flaps being in facing engagement with said elongated flat surface of said hinge bracket means;

said hinge bracket means being longitudinally slidable within said channel of said first door bracket means for removal therefrom and being longitudinally slidable in the same fashion within said channel of said second door bracket means for permitting reversal of the mounting of said hinge bracket means from said first edge of said door to said second edge of said door;

securing means for detachably securing said one hinge flap and said channel of said first door bracket means or within said channel of said second door bracket means.

11. A reversible hinge door assembly according to claim 10 wherein said second sealing member is of dual-durometer construction with said sealing flap thereof being constructed of a material which is more flexible than the material of the remainder of said second sealing member.

12. A reversible hinge door assembly according to claim 10 wherein said first sealing member is of dual-durometer construction with said sealing flap thereof being constructed of a material which is more flexible than the remainder of said first sealing member.

13. A reversible hinge door assembly according to claim 10 wherein said second sealing member further comprises in cross section a pair of spaced apart C-legs and a C-web extending between said pair of C-legs, said C-legs retentively embracing said second edge of said door therebetween with said C-web being in covering relation over said second edge of said doors.

* * * * *